US007013785B2

(12) United States Patent
Torrents I Comas

(10) Patent No.: US 7,013,785 B2
(45) Date of Patent: Mar. 21, 2006

(54) CERAMIC CUTTERS

(75) Inventor: Josep Torrents I Comas, Rubi (ES)

(73) Assignee: Germans Boada, S.A., (ES)

( * ) Notice: Subject to any disclaimer, the term of this patent is extended or adjusted under 35 U.S.C. 154(b) by 0 days.

(21) Appl. No.: 10/089,806

(22) PCT Filed: Aug. 2, 2001

(86) PCT No.: PCT/ES01/00313

§ 371 (c)(1),
(2), (4) Date: Aug. 13, 2002

(87) PCT Pub. No.: WO02/11962

PCT Pub. Date: Feb. 14, 2002

(65) Prior Publication Data

US 2003/0047056 A1 Mar. 13, 2003

(30) Foreign Application Priority Data

Aug. 2, 2000 (ES) ..... 200002046 U

(51) Int. Cl.
*B26D 3/08* (2006.01)
*B28D 1/24* (2006.01)

(52) U.S. Cl. ..... 83/886; 83/665; 83/676; 83/698.11; 225/96.5; 125/23.02

(58) Field of Classification Search ..... 83/886, 83/879, 614, 522.11, 522.17, 468, 468.1, 83/468.2, 881, 467.1, 665, 676, 698.41, 698.11; 225/96.5, 96; 125/12, 24, 23.02, 16.03
See application file for complete search history.

(56) References Cited

U.S. PATENT DOCUMENTS

| | | | | |
|---|---|---|---|---|
| 1,995,741 | A * | 3/1935 | Granite | 125/23.02 |
| 5,040,445 | A * | 8/1991 | Liou | 83/886 |
| 5,169,045 | A * | 12/1992 | Liu | 225/96.5 |
| 5,303,690 | A * | 4/1994 | Ishii | 125/23.02 |
| 5,331,877 | A * | 7/1994 | Ishii | 83/886 |
| 5,480,081 | A * | 1/1996 | Wilson et al. | 225/96.5 |

(Continued)

FOREIGN PATENT DOCUMENTS

| | | | |
|---|---|---|---|
| ES | 2101612 | 7/1997 | 1/22 |

OTHER PUBLICATIONS

Copy of the USPTO Translation of ES 2101612.*

*Primary Examiner*—Boyer D. Ashley
(74) *Attorney, Agent, or Firm*—Ostrolenk, Faber, Gerb & Soffen, LLP

(57) ABSTRACT

A ceramic cutting device having a base, longitudinal guides mounted to the base, and a support movably mounted on the longitudinal guides. A cutting-wheel handle holder is pivotably mounted to the support. A cutting-wheel handle is mounted to the handle holder and the cutting wheel is mounted to the handle. An actuating lever is mounted in a threaded hole in the handle holder so as to immobilize the handle so that the handle can apply pressure on a ceramic piece to be cut via the cutting wheel. The cutting wheel handle has an outer periphery with at least three longitudinally extended rebates which have a geometry that reduces the frequency of vibration during scoring of the ceramic piece by the cutting-wheel. The handle further has at least one longitudinally extending planar surface for engaging with the actuating lever.

2 Claims, 2 Drawing Sheets

U.S. PATENT DOCUMENTS 5,560,274 A * 10/1996 Turner ..... 83/886
5,626,124 A * 5/1997 Chen ..... 125/23.02
6,012,441 A * 1/2000 Liu ..... 125/35
6,148,810 A * 11/2000 Hepworth ..... 125/23.01
6,164,272 A * 12/2000 Fouy ..... 125/12
6,269,994 B1 * 8/2001 Harrington ..... 225/96.5

* cited by examiner

CERAMIC CUTTERS

THE AIM OF THE INVENTION

This invention deals with the improvements made to manually actuated ceramics cutting machines that include the means for the movement of a scoring tool over the ceramic tile defining thereupon the breakage or cutting line.

The improvements mentioned refer basically to the cutting-wheel handle or cutting tool and the corresponding cutting-wheel handle holder.

BACKGROUND TO THE INVENTION

Manual ceramics cutters generally consist of a base to support the piece of ceramic to be cut, some longitudinal guides for the movable assembly of a support on which the folding cutting-wheel handle holder is mounted, on which the cutting-wheel handle is fixed, and an actuating lever to press and move the cutting-wheel on the ceramic thus scoring the breakage or cutting line.

The cutting-wheel usually comprises a small cutting disk made of tungsten carbide which is assembled to allow for free rotation on the front end of a handle, the scoring tool conforming the set of the cutting-wheel and the handle, once assembled and fixed on the cutting-wheel handle holder in order to score the breakage or cutting line on the piece of ceramic.

Usually, the cutting-wheel handle has a cylindrical section having in its periphery a longitudinal flat part on which the end of the actuating lever shall act frontally, retaining it in the assembly position with regard to the cutting-wheel handle holder. The end of the actuating lever mentioned is found threaded on in such a way that when inserted into a hole that has been designed to this effect in the cutting-wheel handle holder, it puts pressure frontally against the longitudinal flat part of the cutting-wheel handle, immobilising it in the position of use.

When performing the scoring of a piece of ceramic, the cutting-wheel is subjected to a movement whose frequency may oscillate, according to certain parameters such as the roughness of the surface of the piece of ceramic to be scored and the speed at which the cutting-wheel advances, of between 300 and 4000 hertz.

Another aspect to be taken into account is the vibration caused by the breakage of the surface vitrified enamel layer in which the characteristic parameter is the size of the split which is produced when scoring the piece. In studies carried out on the vibration of the cutting-wheel, it has been determined that the total spectrum of possible frequencies when the cutting-wheel acts on different materials and types of operation is from approximately 300 hertz to 4 kilohertz, with a high variability at low frequencies (in the region of 1 mm) and low variability at high frequencies (in the region of 0.05 mm or less). The low frequencies propagate through the metallic elements such as the cutting-wheel handle, the actuating lever and the machine frame while the high frequencies attenuate rapidly in the elements of the machine, making them propagate through the air causing the characteristic noise that these machines make in the scoring process.

With the use of the scoring tools currently used that are composed of the cutting-wheel—handle set, a series of disadvantages arises such as: the important shortening of the service life of the cutting-wheel, the defective scoring on certain materials such as on stoneware where discontinuous scoring has sometimes been reported due to the vibration of the cutting-wheel handle, or the transmission of vibrations to the machine and operator during the scoring process.

DESCRIPTION OF THE INVENTION

In order to solve the above mentioned problems, the following improvements have been invented and introduced for ceramic cutting machines, which are the aim of this invention, and are simple in their construction and contribute a series of advantages as far as obtaining a continuous scored line is concerned and a reduction in the vibration transmitted via the cutting-wheel—handle set to the cutter.

In accordance with the invention, and being the ceramic cutter of the type that we have previously mentioned, the provision of at least three longitudinal rebates of any geometry in the periphery of the cutting-wheel handle which extend over substantially the entire length of the handle has been made, whose aim is to reduce the frequency of vibration during the scoring process, and, at least one coplanar or rebated longitudinal plane with respect to the general exterior surface of the handle for the actuation of the end of the lever with the job of fixing it to the machine's cutting-wheel handle holder.

It is noteworthy that the definition of the aforementioned longitudinal rebates in the cutting-wheel handle provide a considerable reduction in its inertia and section with respect to those that are currently used, significantly reducing the frequency of vibrations and their magnitude independently of the section or geometry of the aforementioned longitudinal rebates.

As a consequence of the important reduction in the vibration frequency, the cutting tool gains a series of significant advantages such as higher quality of scoring of the ceramic to be cut, a longer service life of the cutting-wheel and less frequency of resonance.

Another of the improvements generated by this invention is the fact that the cutting-wheel handle holder has a housing whose transversal cross section coincides with that of the cutting-wheel handle giving a maximum contact surface between both the elements and together with the fixing carried out by the actuating lever, hyperstatic fixing of the cutting-wheel handle to the machine. This hyperstatic fixture reduces the natural frequency of vibration and its transmission to the cutter.

DESCRIPTION OF DIAGRAMS

In order to complete the description of what is being done, and with the aim of making the reader's understanding of the invention's characteristics clearer, a set of diagrams is attached to the description in which the following items are represented for illustration purposes.

PREFERABLE REALISATION OF THE INVENTION

Figure 1:
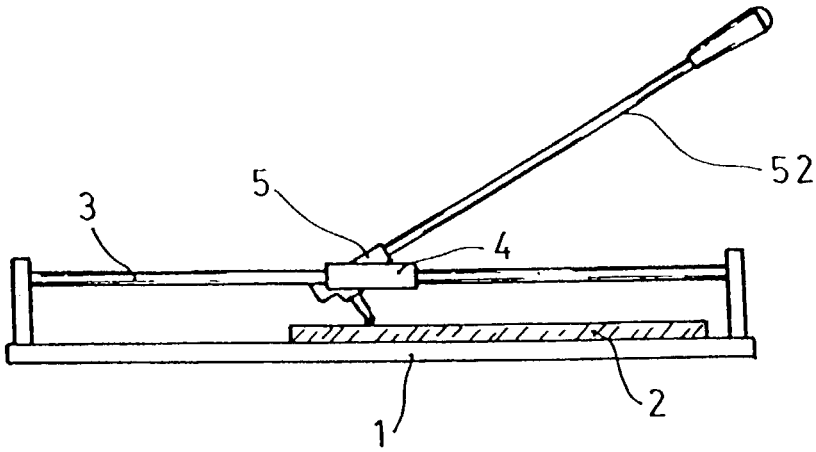
FIG. 1 shows a cross section of a manual ceramics cutter with the improvements that are the aim of this invention.
Figure 2:
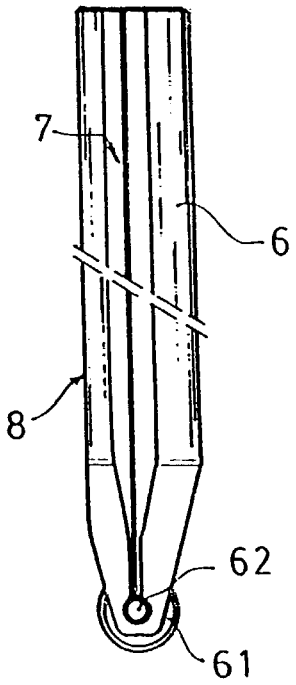
FIGS. 2 and 3 show different sections of the scoring tool that comprises the corresponding cutting-wheel and handle.

As you may observe in FIG. 1, the ceramics cutter to which improvements have been made consists of a base (1)

in order to support the ceramic piece (2) to be cut and some longitudinal guides (3) on which a support is assembled with the possibility of movement (4) on which a folding cutting-wheel handle holder (5) is held.

The cutting-wheel handle holder (5) has a hole (51) for the insertion of the handle (6) of the cutting-wheel (61) and a threaded hole for the assembly of the end of the actuating lever (52) whose job is to fix the handle (6) in the interior of the cutting-wheel handle holder (5). Once the lever (52) is assembled on the cutting-wheel handle holder (5) and the tightness of the handle (6) has been established through the actuation of the lever, the inclination of the cutting-wheel handle holder can be varied until the cutting-wheel (61) establishes contact with the piece of ceramic (2) to be scored and cause the longitudinal movement of the lever following a rectilinear trajectory that has been defined by the guides (3).

The improvements introduced to this cutter concentrate basically on the handle (6) of the cutting-wheel (61) and on the cutting-wheel handle holder (5). In accordance with these improvements, the handle (6) has at least three longitudinal rebates (7) whose aim is to reduce the inertia and the frequency of vibration during the process of scoring the ceramic piece(s) (2).

In the example shown, these longitudinal rebates (7) have a triangular section, although any other section would be valid since the geometrical aspect does not affect the advantages provided by the definition of the rebates (7) in the handle (6).

As usual, the cutting-wheel or scoring disk (61) will be assembled on the handle (6), with the possibility of free rotation on the corresponding axis (62).

Figure 3:
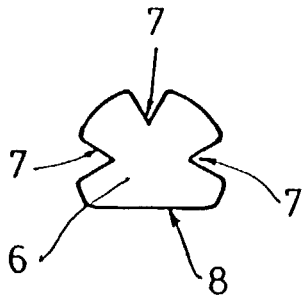
Figure 4:
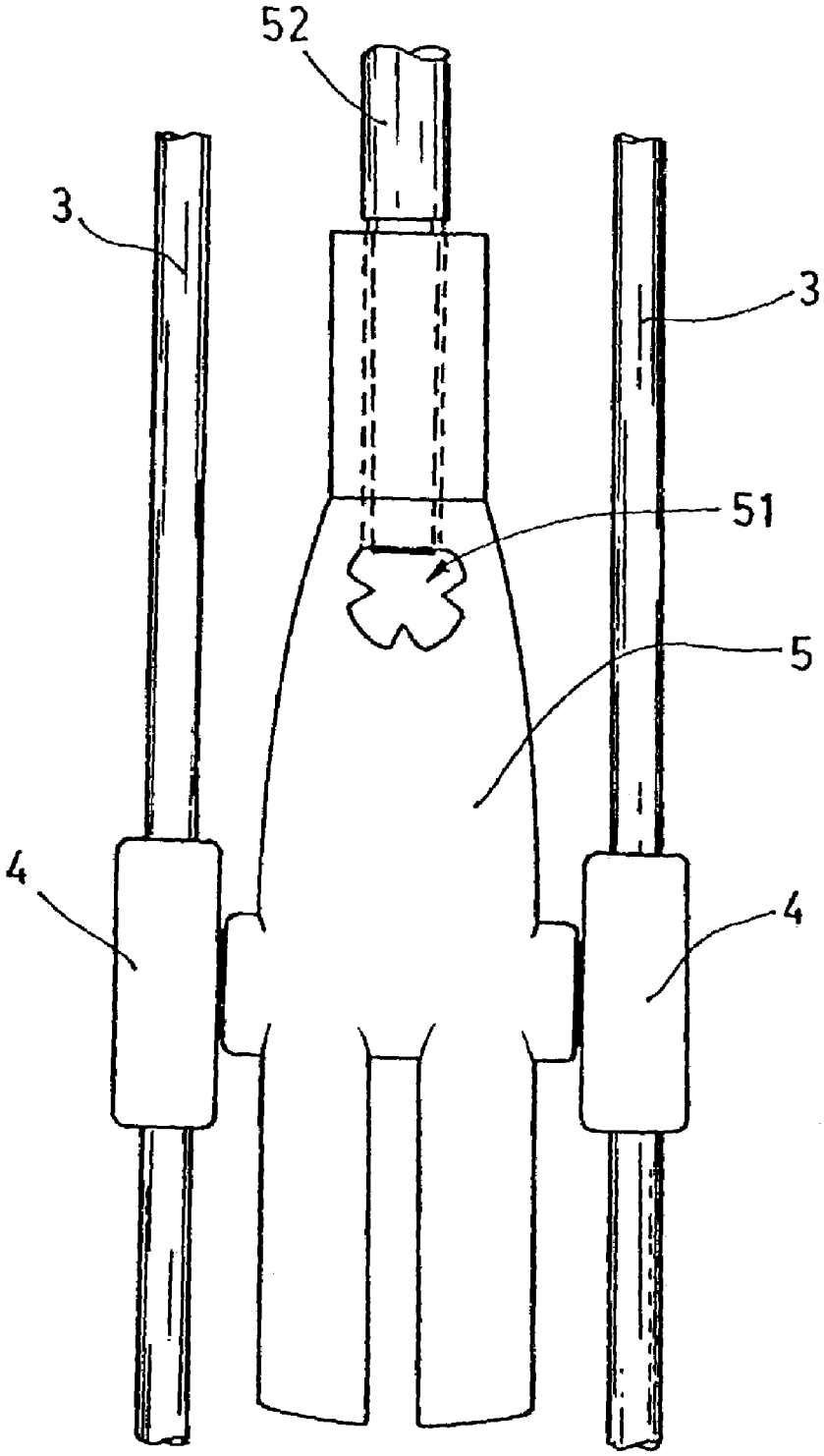
FIG. 4 is a section from below of the cutting-wheel handle holder in which the hole for the fixing of the cutting-wheel handle can be appreciated and its fixing with the actuating lever. In this case, the section of the hole corresponds to the section of the cutting-wheel shown in FIGS. 2 and 3.

The handle (6), as you may observe in FIG. 3, has a longitudinal flat face (8) for the actuation of the end of the lever (52), whose job is to fix it to the cutter's cutting-wheel handle holder (5) in in-use position.

In accordance with the invention, the hole (51) defined in the cutting-wheel handle holder (5) for the insertion of the handle (6) will have a section analogue to that of said handle (6) which shall lead, together with the pressure of the lever (52), to the hyperstatic fixing of the cutting-wheel handle with respect to the cutting-wheel handle holder (5).

Having described in sufficient depth the nature of the invention, and having provided an example of its preferable realisation, it should be noted that the materials, shape, size and disposition of the elements described may be modified as long as this does not involve altering the essential characteristics of the invention which are stated below.

What is claimed is:

1. A ceramic cutting device, comprising:

a base;

longitudinal guides mounted to the base;

a support movably mounted on the longitudinal guides;

a cutting-wheel handle holder pivotably mounted to the support;

a cutting-wheel handle mounted in the handle holder and having a length;

a cutting wheel mounted on the handle; and an actuating lever mounted in a threaded hole in the handle holder so as to immobilize the handle so that the handle applies pressure on a ceramic piece to be cut via the cutting-wheel, the cutting wheel handle having an outer periphery with at least three longitudinally extending rebates that extend over substantially the entire length of the cutting wheel handle, the rebates having a geometry so as to reduce a frequency of vibration during scoring of the ceramic piece by the cutting-wheel, the cutting-wheel handle further having at least one longitudinally extending planar surface for engaging the actuating lever.

2. The ceramic cutting device according to claim 1, wherein the cutting-wheel handle holder forms a housing having a transverse section that corresponds to a transverse section of the cutting-wheel handle so as to provide maximum surface contact between the handle holder and the handle, and, together with an end of the actuating lever, a hyperstatic fixing of the cutting-wheel handle with the cutting-wheel handle holder.

* * * * *